United States Patent [19]

Klopp et al.

[11] Patent Number: 4,560,846

[45] Date of Patent: Dec. 24, 1985

[54] INCREASED CAPACITY PROGRAM TIMER

[75] Inventors: Jerome C. Klopp, Arlington Heights; John Willigman, Elk Grove Village, both of Ill.

[73] Assignee: The Singer Company, Stamford, Conn.

[21] Appl. No.: 672,520

[22] Filed: Nov. 19, 1984

[51] Int. Cl.[4] ..... H01H 43/00

[52] U.S. Cl. ..... 200/38 R; 200/38 A; 200/38 C

[58] Field of Search ..... 200/38 R, 38 A, 38 F, 200/38 FA, 38 B, 38 BA, 38 C, 38 CA

[56] References Cited

U.S. PATENT DOCUMENTS

| | | | |
|---|---|---|---|
| Re. 29,158 | 3/1977 | Cartier et al. | 200/38 B |
| 3,094,593 | 6/1963 | Bowman | 200/38 A |
| 3,390,243 | 6/1968 | Obermann | 200/283 |
| 3,431,372 | 3/1969 | Obermann | 200/38 A |
| 3,581,028 | 5/1971 | Valbona | 200/38 R |
| 3,809,831 | 5/1974 | Godwin et al. | 200/38 C |
| 3,866,002 | 2/1975 | Underwood et al. | 200/33 R |
| 4,146,760 | 3/1979 | Voland | 200/38 A |
| 4,246,454 | 1/1981 | Ray | 200/38 F X |
| 4,288,671 | 9/1981 | Morrison | 200/38 A X |
| 4,297,545 | 10/1981 | Darner | 200/38 R |
| 4,412,110 | 10/1983 | Wojtanek | 200/38 A X |
| 4,497,986 | 2/1985 | Zink et al. | 200/38 A X |

*Primary Examiner*—J. R. Scott

*Attorney, Agent, or Firm*—David L. Davis; Robert E. Smith; Edward L. Bell

[57] ABSTRACT

A program timer wherein a single three blade switch assembly is utilized for both the line switching function and a cam track operated switch.

6 Claims, 10 Drawing Figures

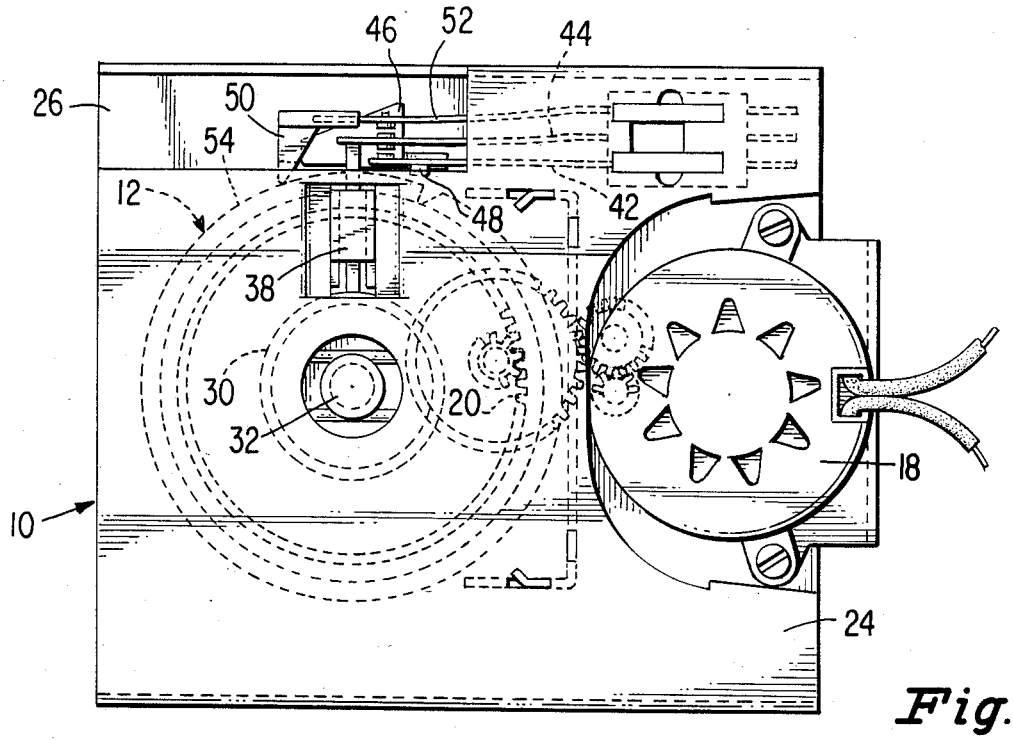
Fig. 4A.
Fig. 3.
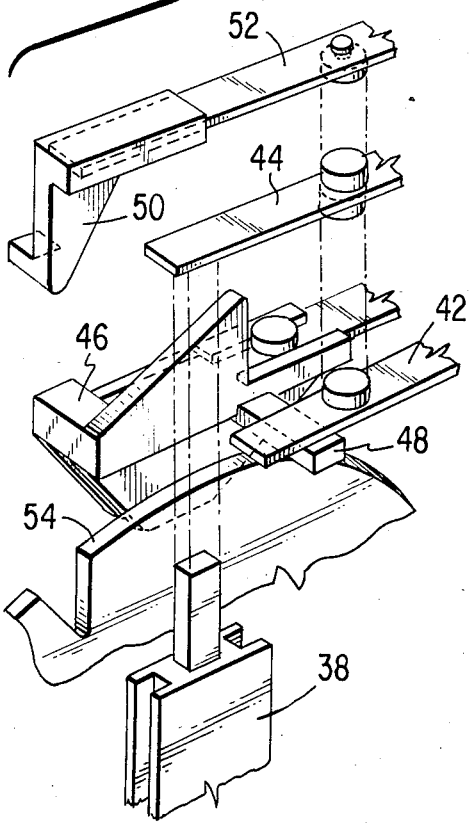
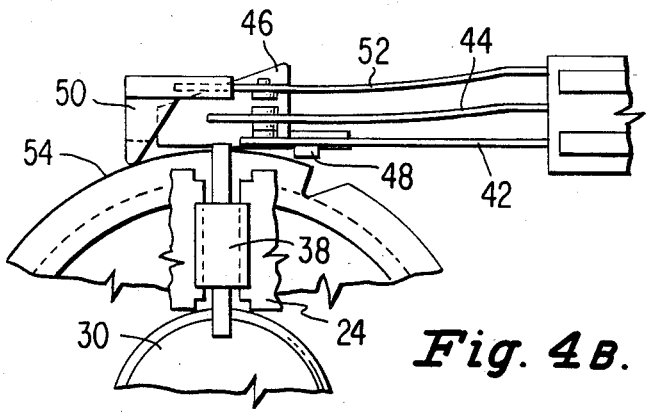
Fig. 4B.
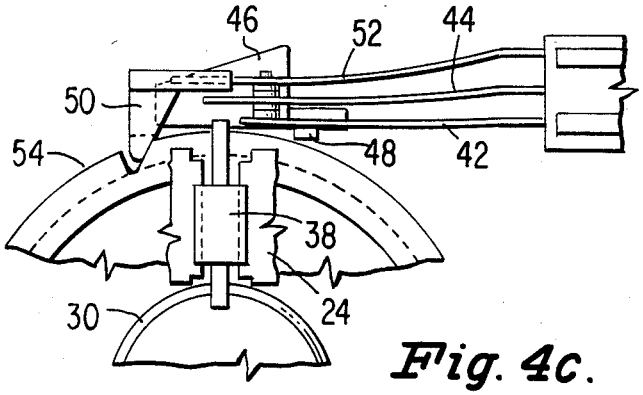
Fig. 4C.

INCREASED CAPACITY PROGRAM TIMER

BACKGROUND OF THE INVENTION

This invention relates to program timers for household appliances and the like, and, more particularly, to an arrangement for providing an additional switching function in such a timer without increasing the size of the timer.

A conventional program timer includes a program drum which is molded to provide a multiplicity of timing cams contoured to actuate switches in sequence as the drum rotates. The drum is molded with a hollow hub which is journalled in the front and back plates of the timer frame. Typically, the drum covers substantially all of the distance between the front and back plates. The switches are typically grouped in assemblies each having upper and lower passive blades with an active blade therebetween. Each such assembly is associated with one of the cam tracks on the drum and a cam follower is associated with the active blade to cause the active blade to selectively contact one of the passive blades as required by the cam track as the drum is rotated.

The timer also includes a line switch through which power is applied to a motor for rotating the drum and to other electrical components of the device controlled by the timer. Conventionally, the line switching function is accomplished utilizing the active and upper passive blades of a switch assembly, with the lower passive blade being removed. The cam track associated with that switch assembly is then unused. It is therefore an object of the present invention to provide an arrangement to allow this cam track to be used by taking full use of the double throw switch assembly for both line and cam switching.

SUMMARY OF THE INVENTION

The foregoing and additional objects are attained in accordance with the principles of this invention in a timer having a motor, a rotatable program cam drum coupled to the motor and journalled in a frame for rotation about an axis, a plurality of cam track operated switches, each switch including a passive blade and an active blade actuated by the cam track to engage the associated passive blade as required by the cam track as the drum is rotated, a line switch for selectively applying power to the timer, the line switch including a passive blade and an active blade actuated by a slide block, wherein the improvement comprises an additional cam track operated switch including an active blade, a cam follower member associated with one of the cam tracks and arranged to move the additional switch active blade into contact with one of the line switch blades as required by the one cam track, whereby the line switch position is shared by the line switch and the additional cam track operated switch.

BRIEF DESCRIPTION OF THE DRAWINGS

The foregoing will be more readily apparent upon reading the following description in conjunction with the drawings in which like elements in different figures have the same reference character applied thereto and wherein:

FIG. 3 is an exploded perspective view showing the first embodiment of a switch assembly in accordance with this invention;

FIGS. 4A, 4B and 4C illustrate the operating conditions of the first embodiment of this invention;

DETAILED DESCRIPTION

Figure 1:
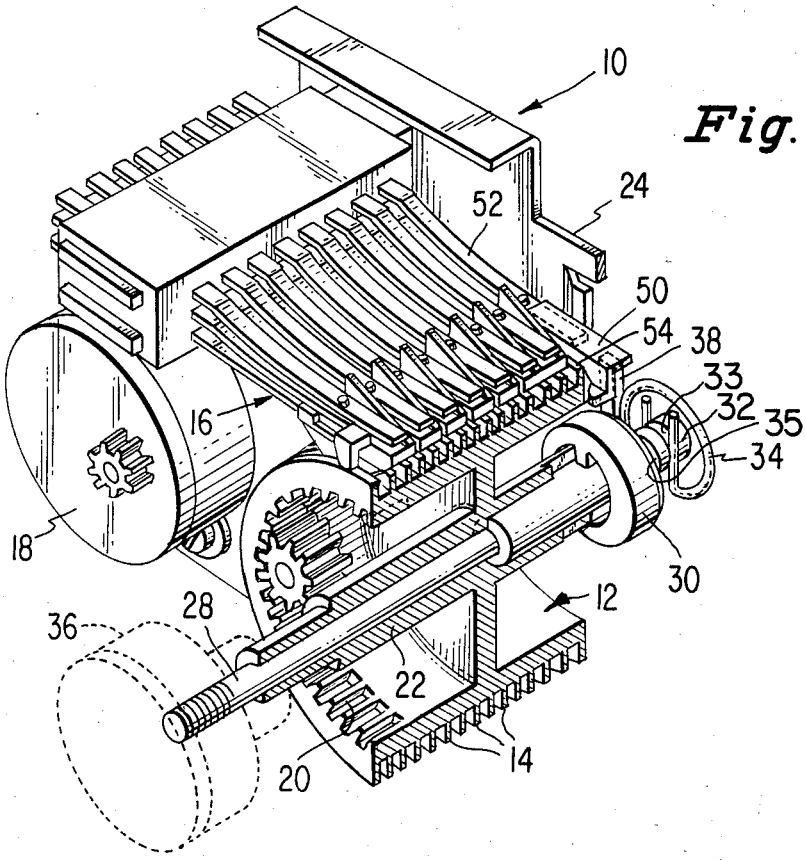
FIG. 1 is a perspective view, partially broken away, of a program timer having incorporated therein a first embodiment of an arrangement constructed in accordance with the principles of this invention.

Referring now to the drawings, shown therein is a program timer, designated generally by the reference numeral 10, which includes a program cam drum 12 molded to provide a multiplicity of timing cams 14 which are contoured to actuate switches 16 in sequence as the drum 12 rotates. The drum 12 is rotated by the motor 18 driving the gear 20 molded on the drum. The drive can be step-by-step or continuous as fits the requirements.

Figure 2:
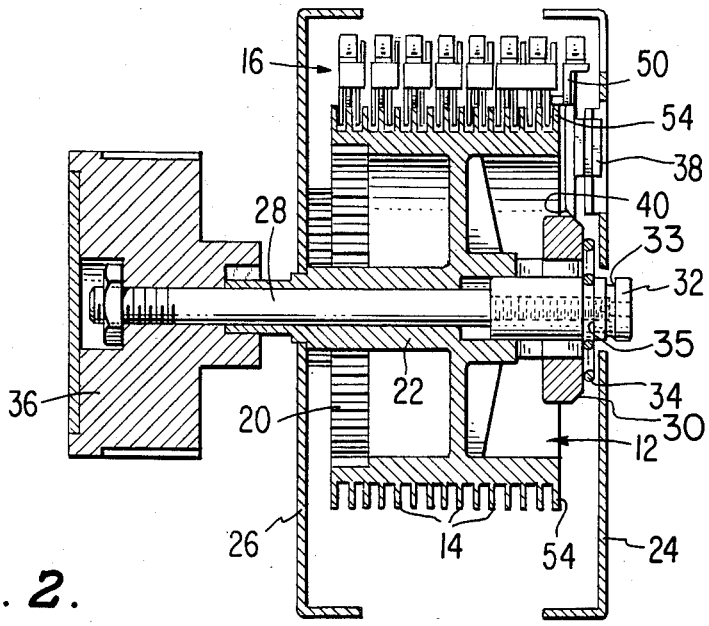
FIG. 2 is a cross-sectional view taken substantially along the axis of the program cam drum of the timer shown in FIG. 1.

The drum 12 is molded with a hollow hub 22. The rear of the hub is journalled in the back plate 24 of the timer frame while the front of the hub is journalled in and projects through the front plate 26. Shaft 28 is mounted inside the hub 22. Line switch operating disc 30 is mounted on the rear end of the shaft 28 for axial movement with the shaft 28. The disc 30 is carried by disc hub 32 which has two peripheral grooves 33 and 35 in either of which the detent spring 34 may rest. The hub 32 is rigidly fixed on the shaft 28 at its rear end and a suitable actuating knob 36 is fixed on the outwardly projecting front end of the shaft 28. The circular portion of the detent spring 34 seats against the inside face of the back plate 24 and its straight legs seat against the hub 32 of the line switch operating disc 30. The shaft 28 can be then be moved from the position shown in FIG. 2 to a more forward position in which the spring 34 seats in the other peripheral groove 33 on the hub 32. In both positions the shaft 28 is drivingly connected to the disc 30. This forward movement of the shaft 28 moves the disc 30 forward and as a result the line switch slide block 38 having cam face 40 engaging the disc 30 is free to move inwardly. The line switch slide block 38 has longitudinal grooves which cooperate with lanced out portions of the back plate 24 to constrain the block 38 for linear movement. This performs the line switching function, which will be described in more detail hereinafter but which is conventional in the art.

The switches 16 are preferably constructed in accordance with the teachings of U.S. Pat. No. Re. 29,158. Accordingly, for each of the timing cams 14 there is a dedicated assembly including upper and lower passive blades and an active blade therebetween. It is conventional to utilize one of the switch assemblies for the line switching function. Therefore, in accordance with conventional practice, that switch assembly could not be used for cam track switching. The present invention affords the capability of using that switch assembly for both line switching and cam track operation, thereby increasing the switching capacity of the timer.

Referring now to FIG. 3, shown therein is an improved line switch assembly according to a first embodiment of this invention. The improved switch assembly includes a lower passive blade 42 and a middle active blade 44. The active blade 44 is self-biased into contact with the passive blade 42. However, when the shaft 28 is in the position shown in FIG. 2, the line switch operating disc-30 pushes the line switch slide block 38 outwardly, forcing the active blade 44 out of contact with the passive blade 42. When the shaft 28 is moved to the left, as viewed in FIG. 2, the slide block 38 is released and the self-biasing force of the active blade 44 allows the active blade 44 to contact the passive blade 42. Also shown in FIG. 3 is the adjacent switch position having a molded assembly 46 in accordance with the teachings of U.S. Pat. No. Re. 29,158. In accordance with the present invention, the molded assembly 46 is formed with an extension 48 molded integrally therewith, which extension 48 prevents inward movement of the lower passive blade 42 under its own self-biasing influence. According to the present invention, a follower 50 is molded on the end of the upper passive blade 52. The follower 50 rides on a previously blank cam track 54 on the cam drum 12. When the follower 50 is on a maximum cam radius, the blade 52 is held at a position leaving the circuit between the blades 44 and 52 open, regardless of the line switch position. When the follower 50 drops to a lower radius on the cam track 54, the blade 52 drops to make contact with the active blade 44.

FIGS. 4A, 4B and 4C illustrate the operation of this switch assembly. In FIG. 4A, the line switch slide block 38 has been moved upwardly by the line switch operating disc 30 to open the line switch. Therefore, no power is applied to the timer 10. In FIG. 4B, the line switch operating disc has been moved so that the slide block 38 no longer forces the blade 44 upwardly. Therefore, the blade 44 contacts the blade 42 and power is applied to the motor 18, causing the drum 12 to rotate and power is also provided to other electrical components of the controlled device, depending on the programs of the cams 14 and their actuation of the switches 16. However, the follower 50 is still riding on the maximum radius of the cam track 54 so that the blade 52 is kept away from the blade 44. In the condition shown in FIG. 4C, the drum 12 has rotated sufficiently so that the follower 50 drops to a lower radius on the cam track 54, allowing the blade 52 to contact the blade 44, closing that cam track operated switch. Thus, in this embodiment, the line switch active blade is shared by the line switch and a cam track operated switch.

Figure 5:
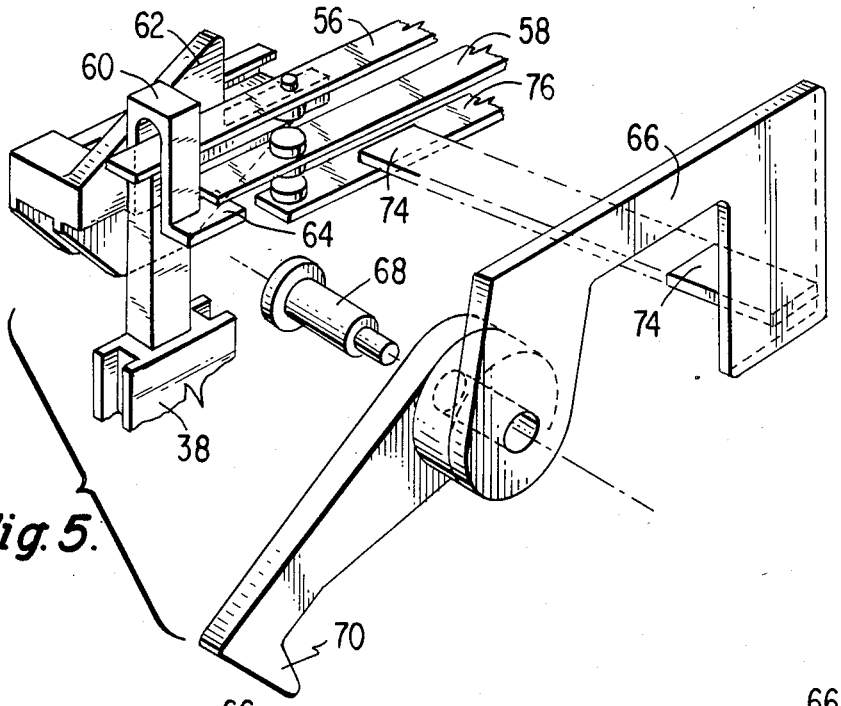
FIG. 5 is an exploded perspective view showing a second embodiment of a switch assembly in accordance with this invention.

Referring now to FIG. 5, shown therein is a second embodiment of a switch assembly constructed in accordance with the principles of this invention. In this embodiment, the upper blade 56 is the line switch active blade and the middle blade 58 is the line switch passive blade. Thus, the line switch slide block 38 acts on the upper blade 56, which is normally biased inwardly, to maintain the blade 56 away from the blade 58 when the shaft 28 is moved toward the right, as viewed in FIG. 2. An arch-like extension 60 molded on the molded assembly 62 of the adjacent switch position straddles the upper blade 56 and terminates in a foot 64 which prevents the middle blade 58 from moving inwardly under its self-biasing influence. To accomplish the cam switching function, there is provided a cam follower member 66 which is pivoted at 68 on the back plate 24. The cam follower member 66 has a cam follower end 70 which tracks the surface of the additional cam track 72 and an actuator end 74 position between the middle blade 58 and the lower blade 76. The lower blade 76 is normally biased outwardly into contact with the middle blade 58. When the cam follower end 70 rides on the maximum radius portion of the cam track 72, the actuator end 74 forces the lower blade 76 inwardly away from contact with the middle blade 58. However, when the cam follower end 70 drops to a lower radius portion of the cam track 72, the lower blade 76 is free to contact the middle blade 58 under its self-biasing influence.

Figure 6A:
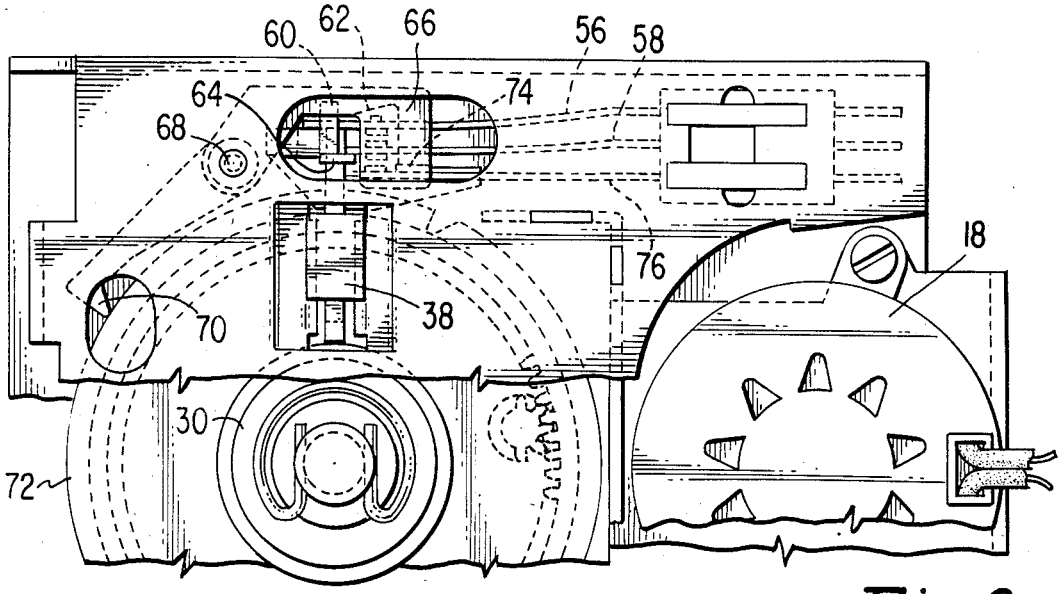
FIGS. 6A, 6B and 6C illustrate the operating conditions of the second embodiment of this invention.
Figure 6B:
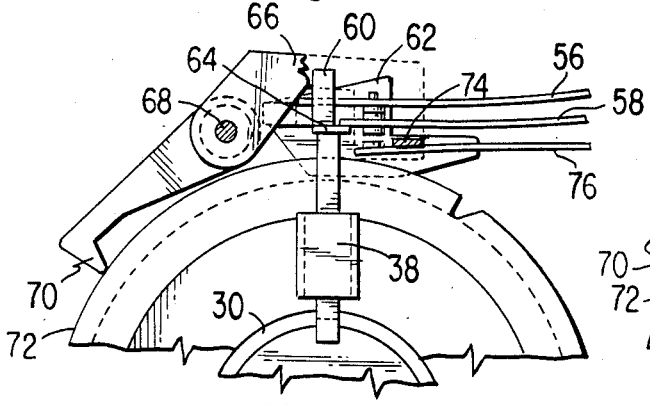
Figure 6C:
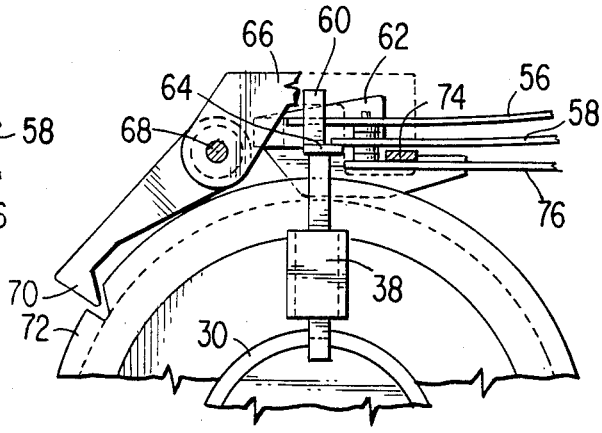

FIGS. 6A, 6B and 6C illustrate the operation of this embodiment. As shown in FIG. 6A, the shaft 28 is the position shown in FIG. 2 so that the line switch slide block 38 forces the upper blade 56 out of contact with the middle blade 58, therepy opening the line switch. In the condition shown in FIG. 6B, the shaft 28 has moved to allow the line switch to close, providing power to the motor 18 to rotate the program cam drum 12 as well as providing power to other electrical components of the controlled device, as discussed above. However, the cam follower 70 is on a maximum radius portion of the cam track 72 so that the blade 76 is out of contact with the blade 58. In the condition shown in FIG. 6C, the cam track 72 has rotated sufficiently so that the cam follower 70 has dropped to a lower radius portion and the lower blade 76 contacts the middle blade 58. Thus, in this embodiment, the line switch passive blade is shared by the line switch and a cam track operated switch.

Accordingly, there have been disclosed arrangements for providing an additional switching function in a program timer without increasing the size of the timer. It is understood that the above-described embodiments are merely illustrative of the application of the principles of this invention. Numerous other embodiments may be devised by the those skilled in the art without departing from the spirit and scope of this invention, as defined by the appended claims.

We claim:

1. A timer having a motor, a rotatable program cam drum having therein a plurality of cam tracks, said drum being coupled to said motor and journalled in a frame for rotation about an axis, a plurality of cam track operated switches, each including a passive blade and an active blade actuated by a respective cam track to engage the associated passive blade as required by said respective cam track as the drum is rotated, a line switch for selectively applying power to said timer, said line switch including a passive blade and an active blade actuated by a slide block, wherein the improvement comprises an additional cam track operated switch including an active blade, a cam follower member associated with one of said cam tracks and arranged to move said additional switch active blade into contact with one of said line switch active blades as required by said one cam track, whereby the line switch position is shared by the line switch and the additional cam track operated switch.

2. The improvement according to claim 1 wherein said cam follower member is molded on said additional switch active blade and moves said additional switch active blade into contact with said line switch active blade as required by said one cam track.

3. The improvement according to claim 2 further including means for preventing movement of said line switch passive blade.

4. The improvement according to claim 1 wherein said additional switch active blade is biased into contact with said line switch passive blade and said cam follower member cooperates with said additional switch active blade to overcome the bias as required by said one cam track.

5. The improvement according to claim 4 further including means for preventing movement of said line switch passive blade.

6. The improvement according to claim 4 wherein said cam follower member is pivoted on the timer frame and has a first cam follower end which follows said one cam track and a second switch actuator end positioned between said additional switch active blade and said line switch passive blade.

* * * * *